US008205885B2

(12) United States Patent
Latour et al.

(10) Patent No.: US 8,205,885 B2
(45) Date of Patent: Jun. 26, 2012

(54) TWO-DIMENSIONAL TILING PUZZLE HAVING THREE-DIMENSIONAL FEATURES

(75) Inventors: Patrick Latour, Terrebonne (CA); Martin Pierre, Saint-Hubert (CA); Victor J. Bertrand, Sr., London (GB)

(73) Assignee: Mega Brands International, Luxembourg, Zug Branch (CH)

( * ) Notice: Subject to any disclaimer, the term of this patent is extended or adjusted under 35 U.S.C. 154(b) by 0 days.

(21) Appl. No.: 13/039,516

(22) Filed: Mar. 3, 2011

(65) Prior Publication Data

US 2012/0049452 A1 Mar. 1, 2012

Related U.S. Application Data

(60) Provisional application No. 61/378,565, filed on Aug. 31, 2010.

(51) Int. Cl.
*A63F 9/10* (2006.01)
*A63F 9/12* (2006.01)

(52) U.S. Cl. ..... 273/157 R

(58) Field of Classification Search ..... 273/157 R, 273/156, 153 R; 446/109, 111, 112, 114, 446/115

See application file for complete search history.

(56) References Cited

U.S. PATENT DOCUMENTS

| | | | | | |
|---|---|---|---|---|---|
| 3,137,967 | A | * | 6/1964 | Flieth | 273/157 R |
| 3,485,496 | A | * | 12/1969 | Brunton | 273/157 R |
| 3,701,214 | A | * | 10/1972 | Sakamoto | 446/115 |
| 4,469,331 | A | * | 9/1984 | Rinker | 273/157 R |
| 4,773,132 | A | | 9/1988 | Eckels | |
| 4,824,112 | A | * | 4/1989 | Roy | 273/157 R |
| 4,874,176 | A | * | 10/1989 | Auerbach | 273/157 R |
| 5,251,900 | A | * | 10/1993 | Gallant | 273/157 R |
| 5,791,647 | A | | 8/1998 | Reiling | |
| 5,860,650 | A | * | 1/1999 | Scobbie et al. | 273/157 R |
| 6,086,067 | A | * | 7/2000 | Benoit et al. | 273/157 R |
| 6,761,354 | B2 | * | 7/2004 | Pavlovits | 273/156 |
| 8,074,988 | B2 | * | 12/2011 | Sakdinan | 273/157 R |
| 2002/0124356 | A1 | | 9/2002 | O'Mahony | |
| 2003/0208887 | A1 | | 11/2003 | Lee | |
| 2006/0097448 | A1 | * | 5/2006 | Kinberg | 273/157 R |
| 2008/0303212 | A1 | * | 12/2008 | Lai et al. | 273/157 R |

FOREIGN PATENT DOCUMENTS

| | | |
|---|---|---|
| BE | 561 414 | 10/1957 |
| EP | 1459790 | 9/2004 |
| FR | 2648358 | 12/1990 |
| WO | WO-97/25117 | 7/1997 |

OTHER PUBLICATIONS

International Search Report and Written Opinion for related International Application No. PCT/IB2011/000454, mailed Nov. 28, 2011.

* cited by examiner

*Primary Examiner* — Steven Wong
(74) *Attorney, Agent, or Firm* — Patton Boggs LLP

(57) ABSTRACT

A tiling puzzle having a first two-dimensional portion and a second three-dimensional portion that extends away from the plane of the first two-dimensional portion.

21 Claims, 17 Drawing Sheets

TWO-DIMENSIONAL TILING PUZZLE HAVING THREE-DIMENSIONAL FEATURES

CROSS-REFERENCE TO RELATED APPLICATIONS

The present application claims priority to U.S. Provisional Patent Application No. 61/378,565, filed Aug. 31, 2010; the content of which is incorporated herein by reference in its entirety.

FIELD OF THE INVENTION

The present invention relates generally to tiling puzzles and more specifically, to a tiling puzzle having a two-dimensional planar section and a three-dimensional section that extends away from a plane of the first two-dimensional portion.

BACKGROUND OF THE INVENTION

Tiling puzzles typically involve the assembly of small flat shapes into a specified larger shape, with no overlapping of the small shapes and usually without gaps between the small shapes. A jigsaw puzzle is one type of tiling puzzle, which typically includes small irregularly cut pieces that fit together to form a picture. The small pieces may interlock with each other. Each small piece usually has a small portion of a picture that, when joined with the picture portions of the remaining small pieces, forms a complete picture.

The most basic tiling puzzles are two-dimensional and are assembled and displayed on a play surface such as a table top. More complicated three-dimensional jigsaw puzzles are known, but typically require complex non-planar interlocking pieces, as well as special means for supporting and displaying an assembled puzzle. There remains a need, therefore, for puzzles that are conveniently assembled and displayed, yet include three-dimensional features that are visually interesting and appealing to users.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIGS. 12A-13C are schematic diagrams of exemplary U-shaped clips for holding individual pieces of a three-dimensional section together.

FIGS. 13A-13C are schematic diagrams of exemplary U-shaped clips for holding individual pieces of a three-dimensional section together.

DETAILED DESCRIPTION OF THE PREFERRED EMBODIMENT

Figure 1:
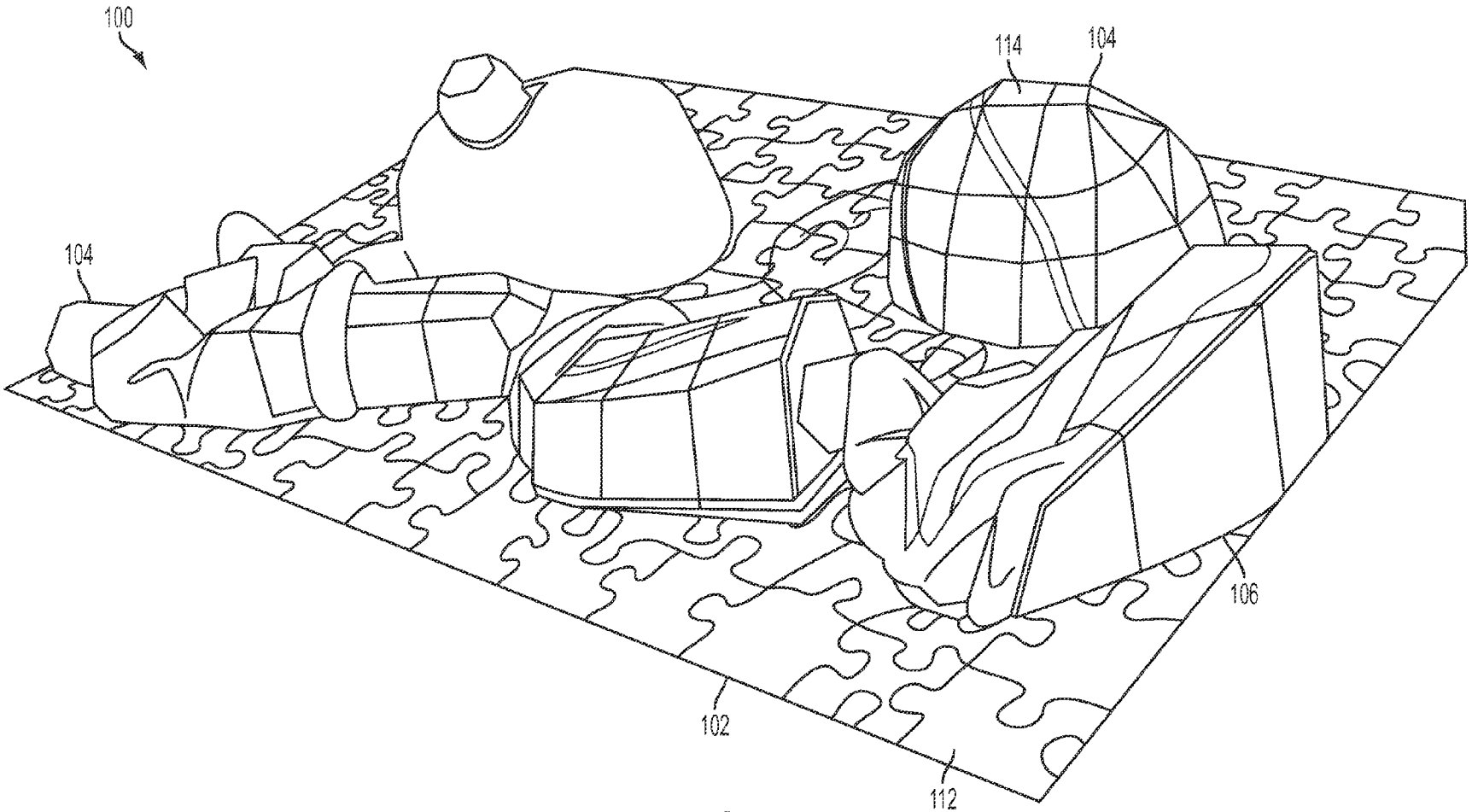
FIG. 1 is a schematic diagram that depicts a perspective view of an embodiment of an assembled tiling puzzle having a two-dimensional section and a three-dimensional section, shown in a horizontal position.

Embodiments of the present invention may provide a two-dimensional tiling puzzle having three-dimensional features that add an exciting level of dimensionality to the puzzle. Other embodiments may be primarily or entirely three-dimensional, for example, a three-dimensional mask, sculptures, artwork, models, etc. The tiling puzzle may be a jigsaw or other type of two-dimensional puzzle, and may be made of cardboard, paper, plastic, etc. The image on the assembled puzzle may include a first portion displaying a first portion of the image that suggests a two-dimensional quality and a second portion that suggests a three-dimensional quality, e.g., by movement, composition, or subject matter. Embodiments may include holographic images in one or more of the tiles. Additionally, three-dimensional printing techniques may be used for viewing with three-dimensional glasses to enhance the three-dimensional effects of the three-dimensional section.

As one example, the image on an assembled puzzle may be a classic wildlife scene of a lone wolf on a ridge. A first two-dimensional portion of the assembled puzzle may depict the ridge and background landscape, while a second three-dimensional portion may depict the wolf, extending out from the two-dimensional portion. The wolf may therefore appear to project out of the puzzle image.

As another example, the image on an assembled puzzle may be an action picture of a person or animated character playing a sport such as basketball. A first two-dimensional portion of the assembled puzzle may depict the basketball court or other background, while a second three-dimensional portion may depict the person or animated character, extending out from the two-dimensional portion. The person or character, as well as any objects that the person or character may be holding or controlling (e.g., a basketball), may therefore appear to project out of the puzzle image.

In one aspect, a tiling puzzle may include a plurality of first pieces that assemble to form a first two-dimensional portion of the puzzle and a plurality of second pieces that assemble to form a second three-dimensional portion of the puzzle. The first pieces may be irregularly shaped flat interlocking pieces. The second pieces may be specially designed, flat pieces that may be folded and attached together to form a hollow three-dimensional structure that extends away from the plane of the two-dimensional portion. The foldable second pieces may fold in particular ways to form the final shape. Instructions on the pieces themselves or instructions included in or on the packaging may instruct a user. For example, different colored lines on the pieces may indicate whether a particular seam is mountain or valley folded, i.e., folded below the plane of the unfolded second piece, or folded above the plane of the unfolded second piece. The folded second pieces may be attached by clips that hold side flaps of adjacent pieces. The first and second pieces may be made of cardboard, paper, plastic or any other suitable material. Alternatively, the flaps of one piece may be inserted into a slot of a mating piece.

When the second pieces are assembled, the second pieces may form raised, three-dimensional images that fit seamlessly into the overall puzzle artwork. The finished puzzle may then be displayed in any number of positions, from vertical to horizontal, to highlight the three-dimensional effect. For example, a vertical display may give the appearance of an object, such as a ball, projecting out of a wall, whereas a horizontal display may give the appearance of an object, such as a building, rising out of the ground. The level of complexity and detail achieved, as well as the number of raised elements within any puzzle may be variable, according to the puzzle's difficulty rating and/or targeted consumer age group.

The second three-dimensional pieces of a puzzle may be die-cut according to patterns created from computer software, allowing virtually any flat-art image to be re-created in three dimensions from a series of foldable flat panels. In one aspect, the second three-dimensional pieces may be attached together and to the two-dimensional section using plastic clips. The plastic clips may be small injection molded devices that function as "paper clips" to securely join the side flaps of adjacent second pieces of the three-dimensional portion of the puzzle on the reverse side of the artwork, such that the clips are not visible to the viewer. Other methods of joining, such as, but not limited to, metal clips, staples, glue or tabs and slots are also within the ambit of the invention. Additionally, tools that apply the clips, stapes, glue, etc. may be used to assist in joining pieces. One or more types or sizes of closures may be used for each puzzle.

One embodiment provides a particularly cost-effective configuration, in that all of the puzzle pieces may be manufactured as flat pieces. For example, both the first two-dimensional pieces and also the second foldable three-dimensional pieces may be manufactured as flat pieces. Separate clips may be used for securely joining adjacent folded three-dimensional pieces, e.g., by joining side flaps of those adjacent folded three-dimensional pieces. The first and second pieces may be packaged in a flat configuration to minimize the costs of packaging and shipping.

FIG. 1 illustrates an embodiment of a tiling puzzle 100 having a first two-dimensional portion 102 and a second three-dimensional portion 104. As shown, the first two-dimensional portion 102 may be a plurality of flat tile pieces 112. In one embodiment, the pieces 112 of portion 102 may be irregularly shaped flat interlocking pieces. The pieces 112 of portion 102 may be made of materials such as cardboard, paper, plastic, or metal. The pieces 112 of portion 102 may assemble together to form a larger shape, such as a rectangle as shown in FIG. 1. The assembled pieces 112 of portion 102 may further define an opening 106 within the larger shape. The opening 106 may be sized and configured to match the base perimeter of the three-dimensional portion 104, so that the three-dimensional portion 104 fits within the opening 106, preferably providing a tight fit with minimal or no gaps between the two-dimensional portion 102 and the three-dimensional portion 104.

As shown in FIG. 1, the three-dimensional portion 104 extends out of the plane of the two-dimensional portion 102. In this example, the three-dimensional portion 104 forms a shape representing an animated character bouncing a basketball, with portions of the character and the basketball projecting out of the plane of the two-dimensional portion 102. The three-dimensional portion 104 may be formed from a plurality of interconnected tile pieces 114. In one embodiment, the tile pieces 114 may be interlocking non-planar jigsaw puzzle pieces that lock together to form a three-dimensional structure. In another embodiment, the tile pieces 114 may be foldable panels that may be folded and attached together. In an embodiment, a foldable panel may include side flaps that mate with side flaps of adjacent foldable panels. The side flaps may be fastened together, for example, using clips, to attach the foldable panels to each other. The tile pieces 114 may be made of materials such as cardboard, paper, plastic, or metal.

Figure 2:
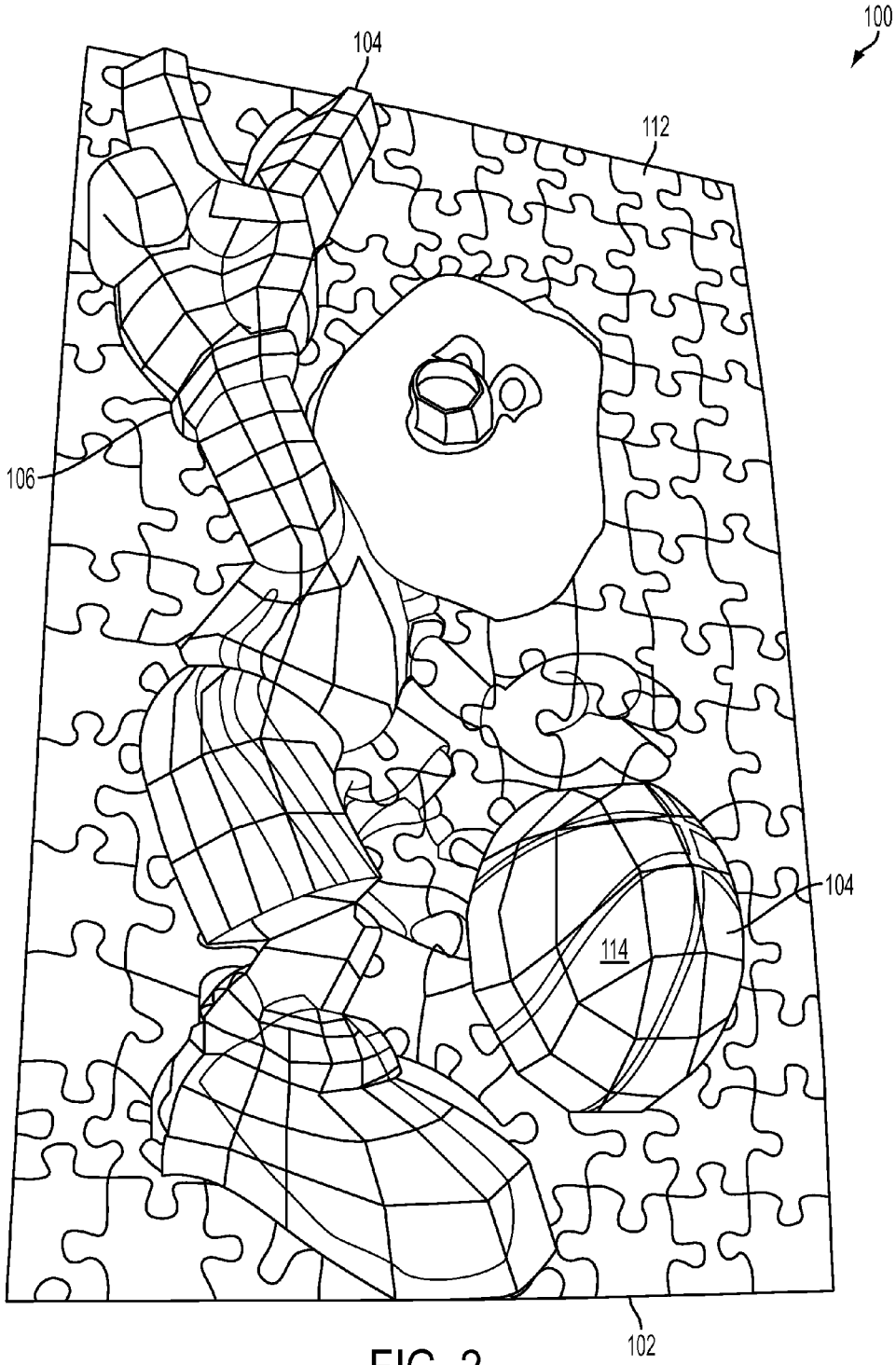
FIG. 2 is a schematic diagram that depicts a perspective view of the assembled tiling puzzle of FIG. 1 in a vertical position.

With the two-dimensional portion 102 and three-dimensional portion 104 assembled, and with the three-dimensional portion 104 fit snugly within the opening 106 defined by the two-dimensional portion 102, the tiling puzzle 100 may comprise a sturdy and stable assembled structure that may be moved and positioned as a unit. To accentuate the visually appealing three-dimensional aspects of the assembly, the puzzle 100 may be vertically positioned, for example, as shown in FIG. 2. This unitary structure of the puzzle 100 therefore facilitates any number of positions of the puzzle from horizontal to vertical, including, for example, displaying the puzzle on a wall. Puzzle 100 may be positioned as appropriate for the image depicted on the puzzle. For example, for a three-dimensional puzzle portion representing a building, the puzzle may be positioned horizontally, with the three-dimensional building portion extending vertically above the two-dimensional puzzle portion. The puzzle 100 may be mounted on a moveable surface or device to allow for rotation or movement of the puzzle 100 for improved viewing based on various view positions. Prior to mounting or hanging, one or more portions of the puzzle may be sealed using adhesive, such as puzzle glue or lacquer, for improved structural integrity and improved aesthetics.

Embodiments of the present invention may also initially be uncolored. An end user may color, paint, etc. on the pieces before or after assembly. In certain embodiments, the puzzle 100 may include paint-by-numbers indications on one or more pieces.

Figure 3:
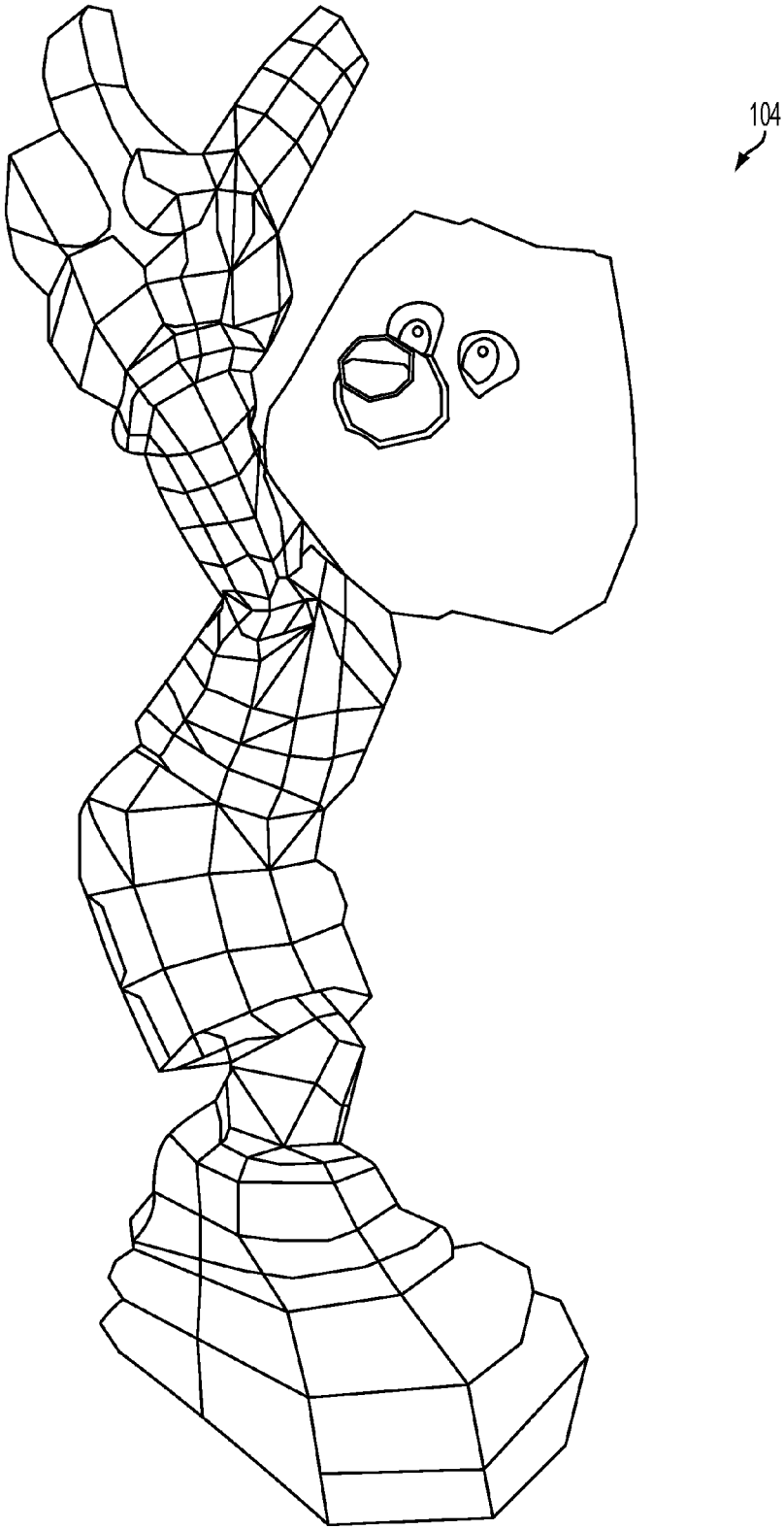
FIG. 3 is a schematic diagram that depicts a top view of a portion of the three-dimensional portion of the tiling puzzle of FIG. 1, with the two-dimensional portion excluded.

For illustration purposes, FIG. 3 shows a portion of the three-dimensional portion 104 in an assembled configuration, before portion 104 would be inserted into the opening 106 of the two-dimensional portion 102. Opening 106 may originally have no pieces 112 in the space for portion 104, or the pieces 112 located within the opening 106 may be removed to accommodate section 104. As shown, the three-dimensional structure formed by portion 104 corresponds to the image depicted in the portion 104, with the portions of the image that would logically extend out farther actually extending out farther. In this example, the nose of the depicted character extends out the farthest to provide a robust three-dimensional effect.

Embodiments provide a plurality of puzzle pieces that may be assembled into a three-dimensional portion, such as the three-dimensional portion 104 of FIG. 3. In one embodiment, the puzzle pieces may include features that enable the pieces to interlock with each other. Such features may include jigsaw shapes, complementary slots, dovetails, integral clips, or other fastening means. In another embodiment, the puzzle pieces may include side flaps that may be placed against each other and fastened to each other, for example, using adhesive, separate fasteners such as clips, or other fastening means.

Figure 4:
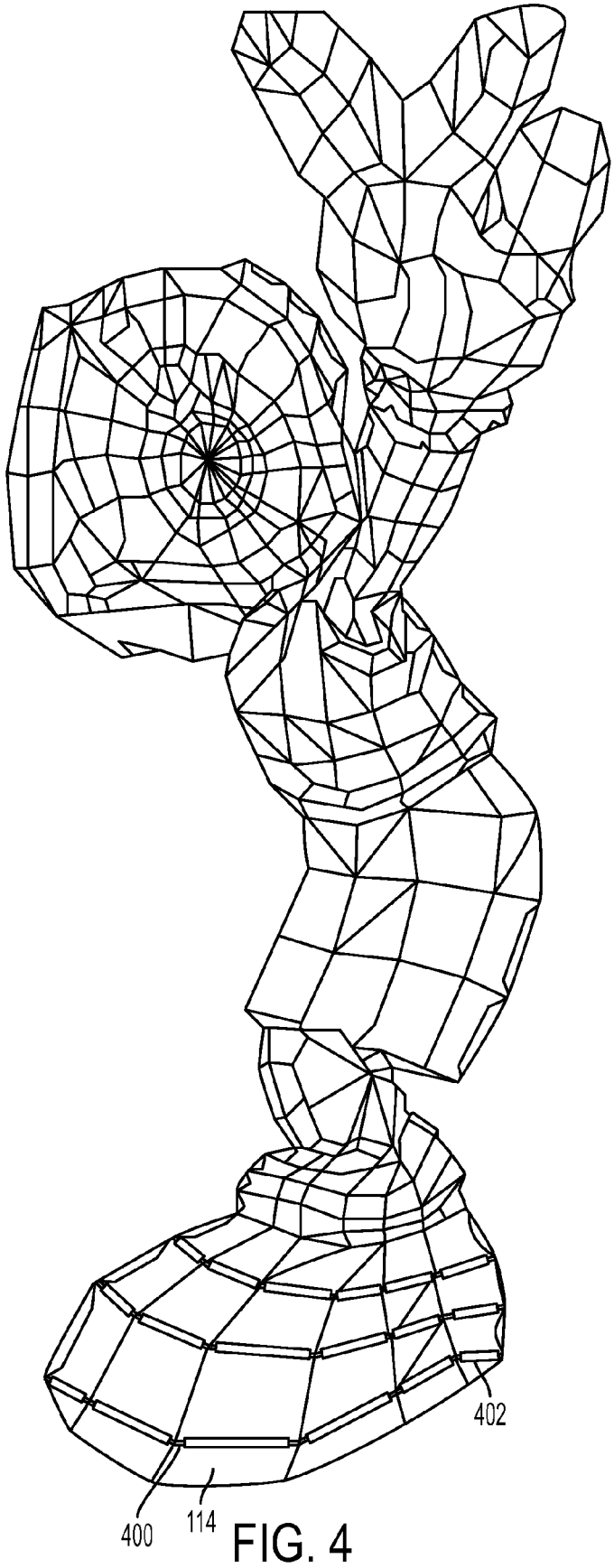
FIG. 4 is a schematic diagram that depicts a bottom view of the three-dimensional puzzle portion of FIG. 3.
Figure 5:
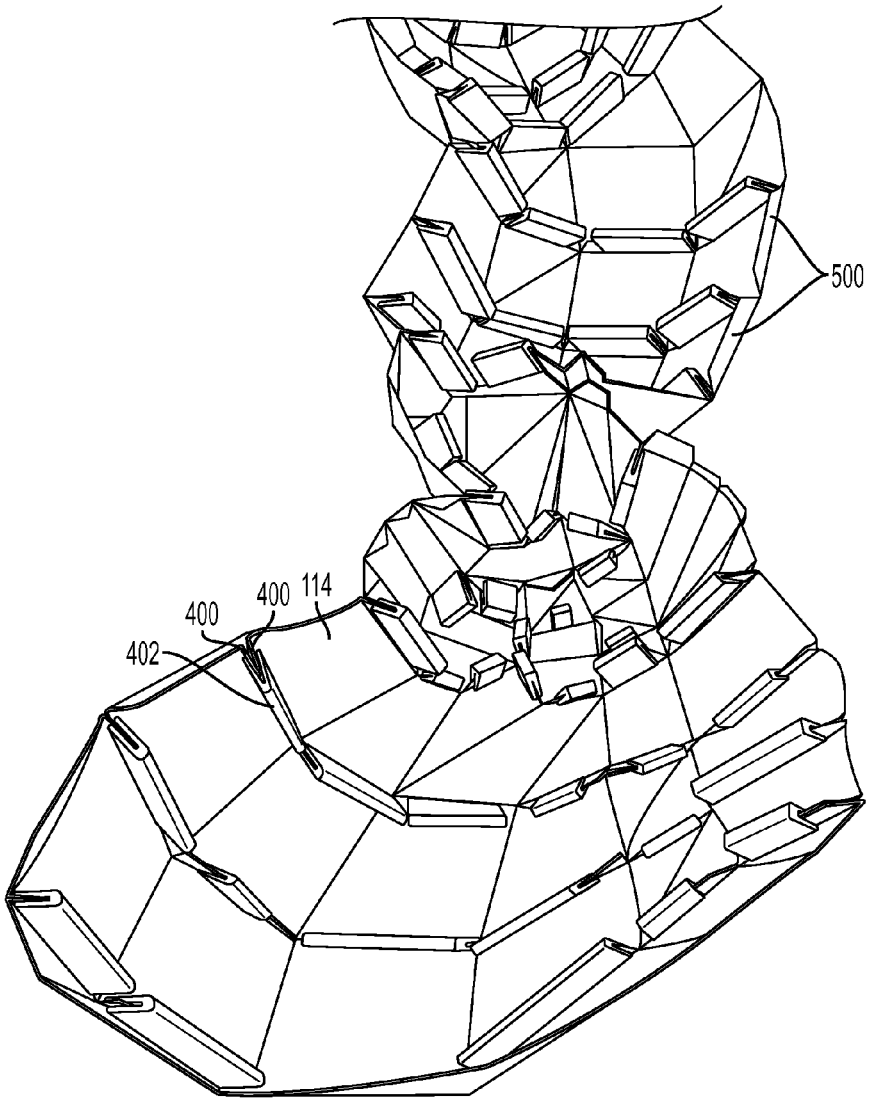
FIG. 5 is a schematic diagram that depicts an enlarged bottom view of a portion of the three-dimensional puzzle portion of FIG. 3.

As one embodiment, FIGS. 4 and 5 illustrate a bottom view of the three-dimensional portion 104 of FIG. 3, in which side flaps 400 and clips 402 are used to assemble the plurality of tile pieces 114 together. Clips 402 may be any structure that holds the flaps 400 together face to face. In one embodiment, as shown, clips 402 may be U-shaped when viewed in a longitudinal cross-section, and may be biased to assume a closed position at the top of the U-shape. A biased clip may be temporarily opened to slide the face-to-face flaps inside and then released such that clip holds the flaps securely together. Clips 402 may be made of, for example, cardboard, heavy stock paper, plastic, or metal.

Figure 6A:
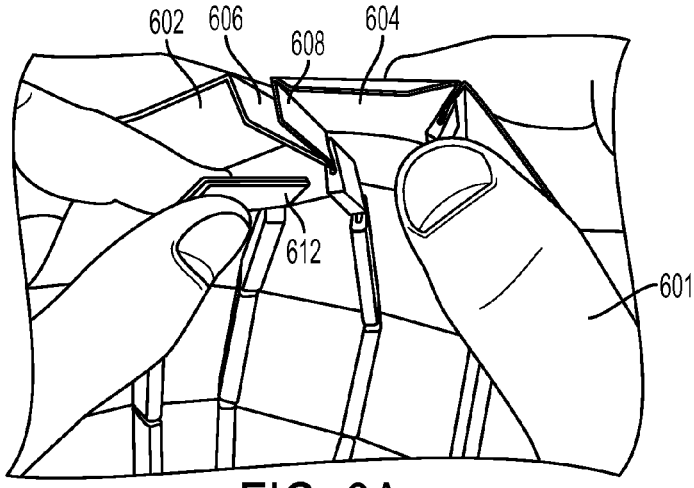
FIGS. 6A-6C are schematic diagrams that depict an embodiment of a method for joining three-dimensional tile pieces and an embodiment of an attachment device.
Figure 6B:
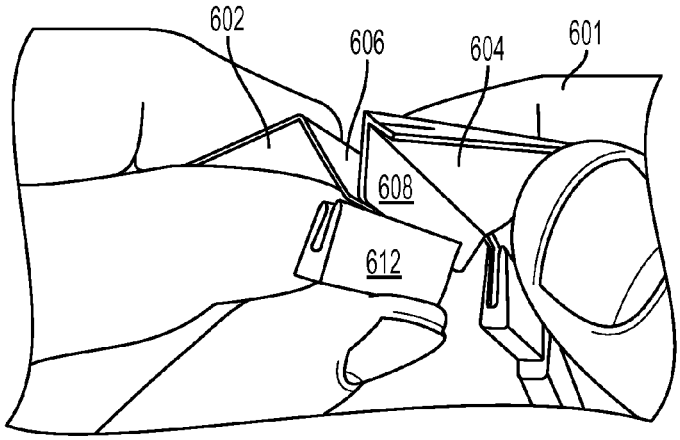
Figure 6C:
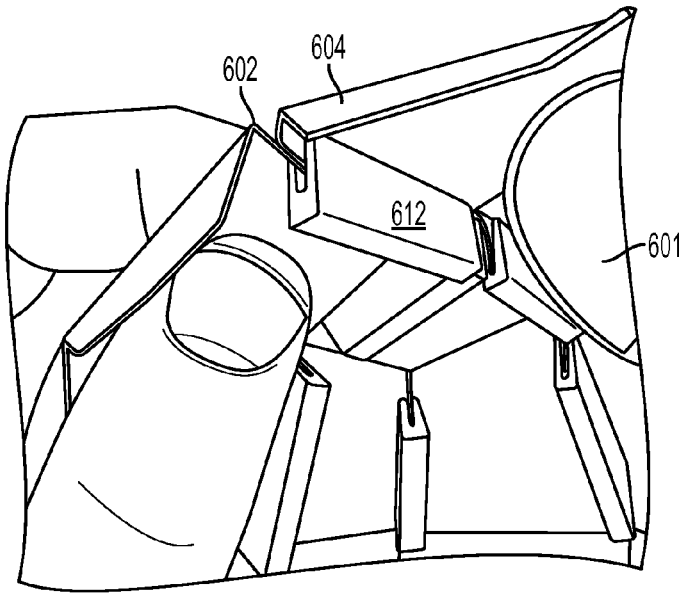

FIGS. 6A-6C illustrate an embodiment of a method for joining three-dimensional puzzle pieces and an embodiment of an attachment device. As shown, a user 601 may assemble a first tile piece 602 to a second tile piece 604 using a clip 612. A first flap 606 of the first tile piece 602 and a second flap 608 of the second tile piece 604 are first folded back from the front faces of their respective tile pieces and positioned face to face, as shown in FIG. 6A. Then, as shown in FIG. 68, the two flaps 606 and 608 are brought close together and inserted into the clip 612. The clip 612 is then pushed over the flaps 606 and 608 so that the flaps 606 and 608 are held face to face in contact with each other. The clip 612 may preferably be sized and configured such that the full surface areas of the flaps 606 and 608 are in contact with each other and such that the folds on the front faces of the tile pieces 602 and 604 are close together, with a minimal gap or no gap, to provide a substantially seamless appearance on the outside of the tile pieces 602 and 604 where the image is displayed. FIG. 6C illustrates an example of flaps 606 and 608 held face to face, with the front faces of the tile pieces 602 and 604 secured close together with no gap.

Figure 7:
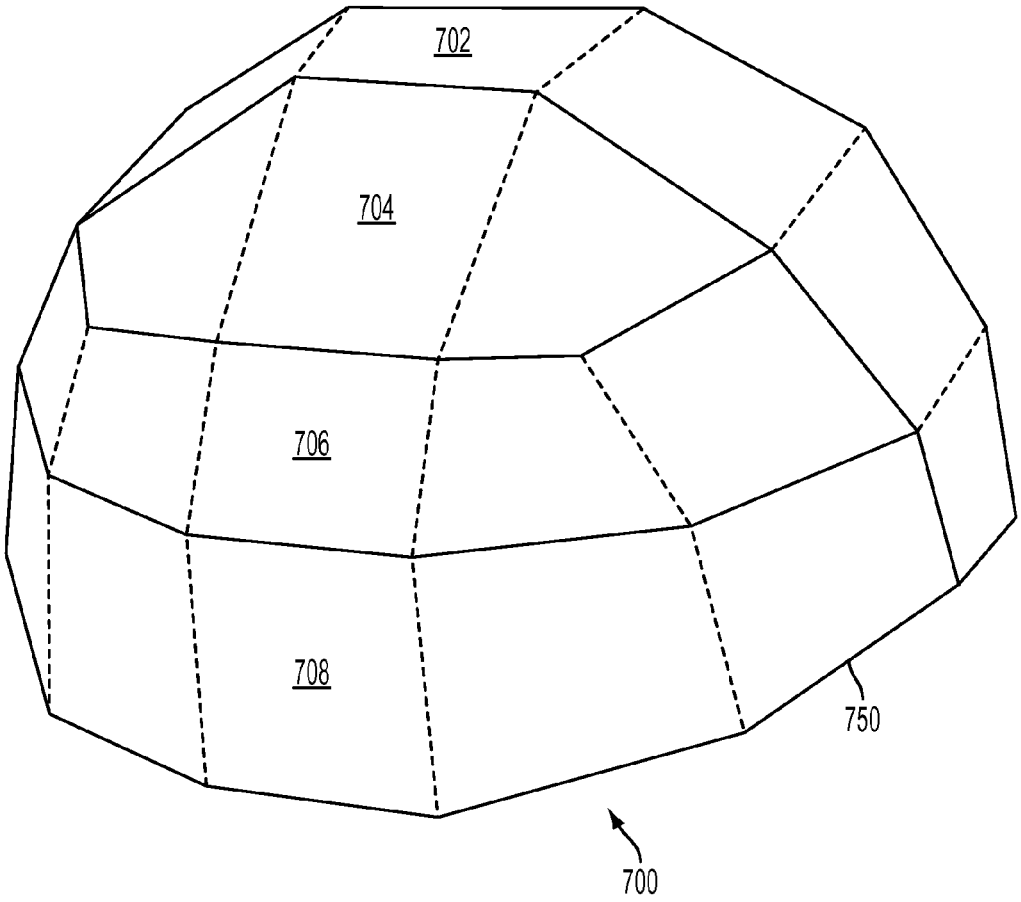
FIG. 7 is a schematic diagram that depicts a perspective view of an embodiment of an assembly of three-dimensional tile pieces into an approximately hemispherical form, representing a ball.

In another embodiment, FIG. 7 illustrates an assembly 700 of three-dimensional tile pieces into an approximately hemispherical form, in this case representing a ball. The tile pieces include upper panel 702, upper intermediate panel 704, lower intermediate panel 706, and lower panel 708. Although only one side of assembly 700 is shown in FIG. 7, depicting the four panels, the assembly may include a like opposite side that includes three additional panels similar to panels 704, 706, and 708. In FIG. 7, the solid lines represent the perimeters of the panels, while the dashed lines represent folds in the panels. The panels 702, 704, 706, and 708 may be attached to each other along their perimeters, as represented by the solid lines. The panels 702, 704, 706, and 708 may be attached to each other by, for example, adhesives or mechanical fasteners.

Figure 8:
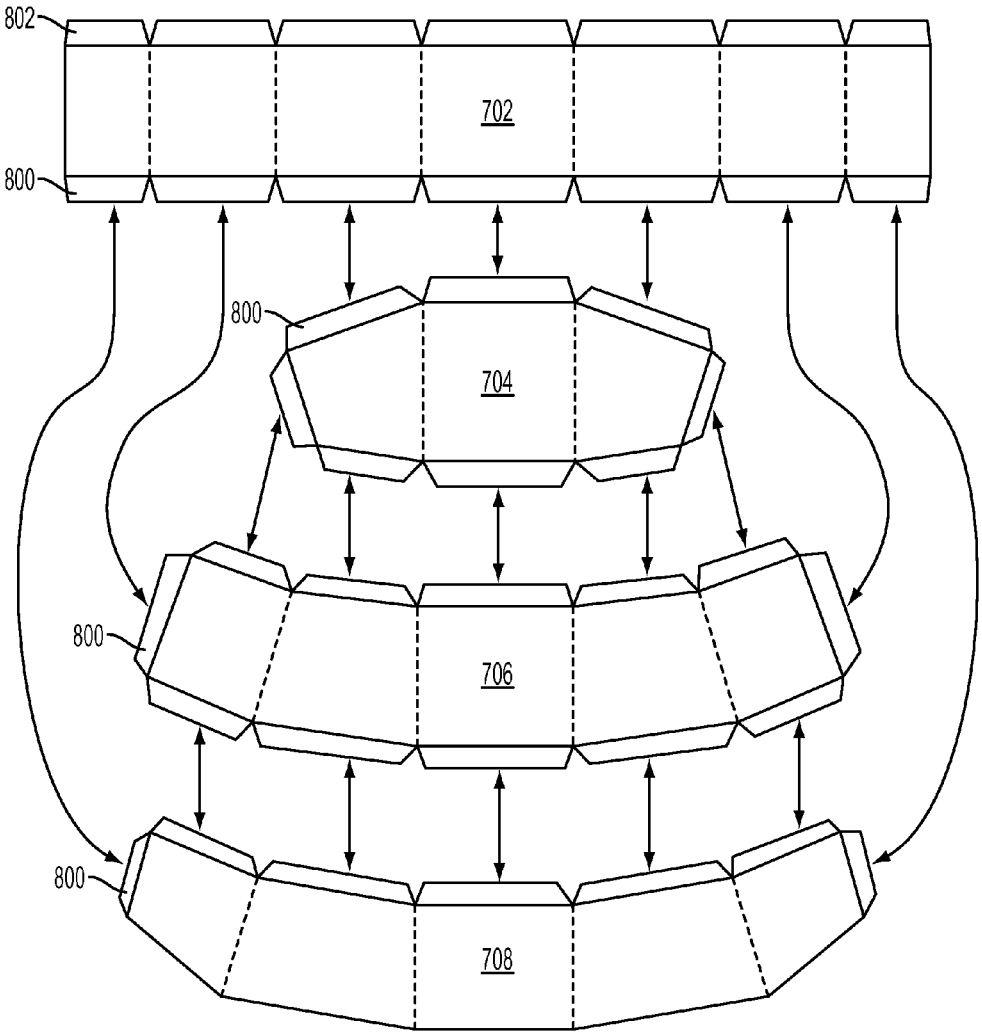
FIG. 8 is a schematic diagram that depicts embodiments of three-dimensional tile pieces that may be joined to form the assembly of FIG. 7, with the tile pieces shown in their initial flat configurations.

In a preferred embodiment, panels 702, 704, 706, and 708 may be attached to each other by side flaps that may be folded back at the perimeters represented by the solid lines. The flaps are folded back and are not viewable in FIG. 7, but are shown in FIG. 8. The panels 702, 704, 706, and 708 may be folded along the dashed lines and shaped to form the hemispherical structure. Once formed, the panels 702, 704, 706, and 708 may then be joined to each other by their flaps 800, as shown by the arrows in FIG. 8. The arrows in FIG. 8 denote each pair of flaps 800 that mate together, after the panels 702, 704, 706, and 708 have been folded at the dashed lines to conform to the hemispherical shape and the flaps 800 have been folded back away from the front faces of the panels. As with FIG. 7, for illustration purposes, FIG. 8 only depicts one side of a hemispherical structure, and although not shown, the assembly may include a like opposite side that includes three additional panels similar to panels 704, 706, and 708, which would attach to the flaps 802 on the side of panel 702 opposite to flaps 800.

As illustrated in FIG. 8, an aspect provides three-dimensional puzzle portions that may be formed from initially flat tile pieces. This allows the three-dimensional tile pieces to be packaged, shipped, and sold in a flat configuration, along with the flat tile pieces of the two-dimensional puzzle portion. This flat configuration may yield cost savings in packaging and shipping, and may enable more product to be shipped, displayed on stored shelves, and sold.

Embodiments also provide methods, structures, and devices for attaching a three-dimensional puzzle portion to a two-dimensional puzzle portion to form a puzzle. This attachment may allow the puzzle to be moved as a single unit, for positioning in a variety of ways, such as vertically on a wall.

In one embodiment, the two-dimensional puzzle portion may define an opening that closely matches the base perimeter of the three-dimensional puzzle portion (such as the base perimeter 750 of FIG. 7), so as to provide an interference fit between the puzzle portions.

In another embodiment, the two- and three-dimensional puzzle portions may be attached using adhesive or an adhesive tape.

In another embodiment, the two- and three-dimensional puzzle portions may be attached using one or more flaps. For example, FIG. 5 shows flaps 500 on a three-dimensional puzzle portion that may be used to attach the depicted three-dimensional puzzle portion to a two-dimensional puzzle portion. Preferably, the flaps 500 are folded inward as shown. In certain embodiments, however, the flaps 500 may be folded outward to rest above or below a flat tile piece of a two-dimensional puzzle portion prior to affixing the two-dimensional portion to the three-dimensional portion, such as with adhesives, staples, clips, etc.

Figure 9A:
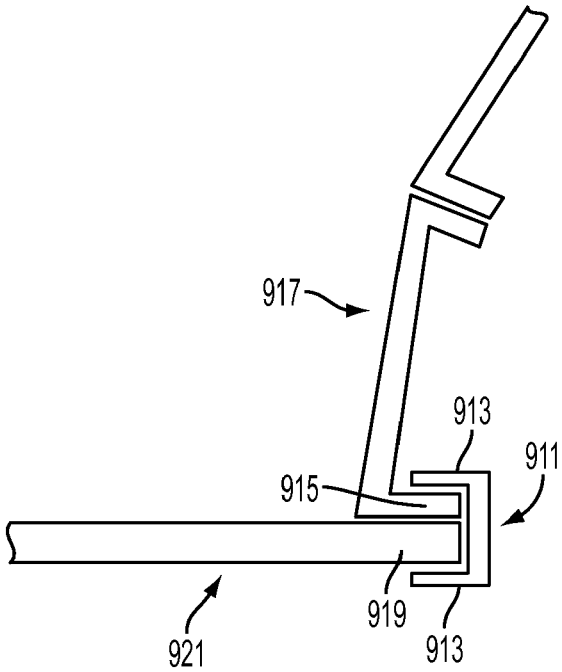
FIG. 9A is a schematic diagram of a cross-sectional view of an L-shaped connector attaching the back of a two-dimensional tile piece to the back of an adjacent three-dimensional tile piece.

In another embodiment, separate fasteners may be used to attach the puzzle portions. Fasteners may be clips or other mechanical mechanisms similar to those used to couple three-dimensional pieces. Various clips are described in more detail below. FIG. 9A illustrates a clip 911 with arms 913 surrounding a tab 915 from a three-dimensional portion 917 and an end 919 of a two-dimensional portion 921. The tab 915 and end 919 may be aligned prior to inserting the clip 911 to secure the two pieces together.

Figure 9B:
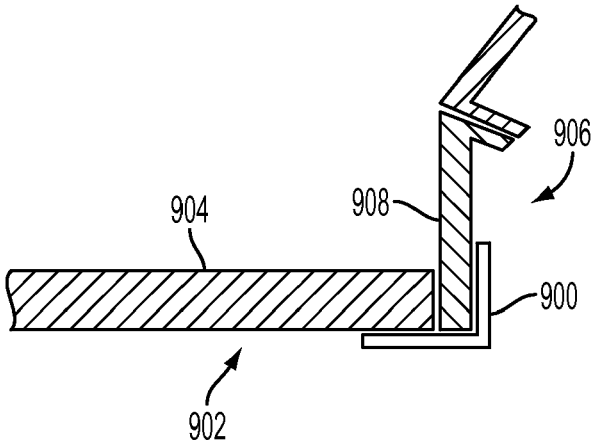
FIG. 9B is a schematic diagram of a cross-sectional view of a U-shaped connector attaching the back of a two-dimensional tile piece to the back of an adjacent three-dimensional tile piece.

Alternatively, another embodiment provides that the fasteners may have specially shaped connectors that fasten to the puzzle portions at the corners at which the portions meet. For example, as shown in the cross-sectional view of FIG. 9B, an L-shaped connector 900 may attach to the back 902 of a two-dimensional tile piece 904 and to the back 906 of an adjacent three-dimensional tile piece 908. Connector 900 may be attached to pieces 904 and 908, for example, by adhesive or by a fastener such as a pin or screw.

Figure 10:
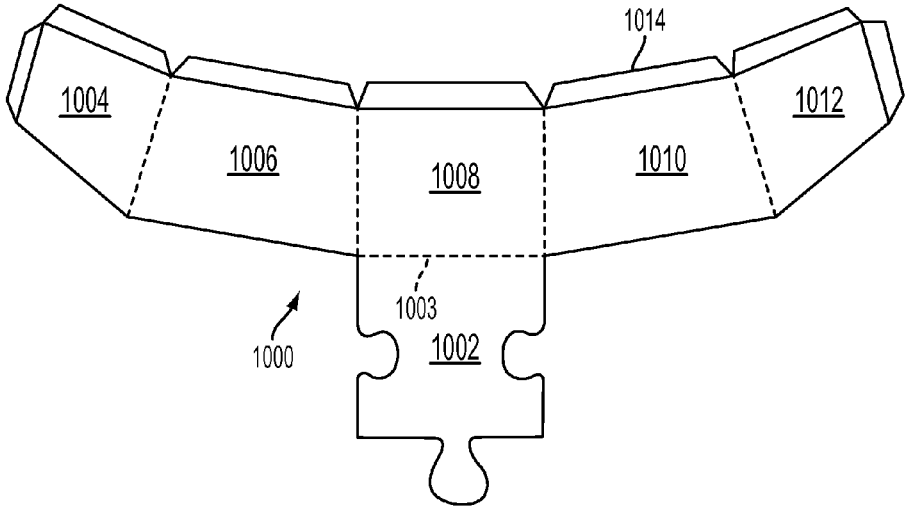
FIG. 10 is a schematic diagram of an embodiment of a three-dimensional tile piece that includes an interlocking portion and folds at a folding line to position the interlocking portion in the same plane as the two-dimensional portion of a puzzle.

Alternatively, another embodiment provides three-dimensional puzzle pieces that include portions that interlock with the two-dimensional puzzle portion. For example, as shown in FIG. 10, a three-dimensional tile piece 1000 may include an interlocking portion 1002 and may fold at a folding line 1003 to position the interlocking portion 1002 in the same plane as the two-dimensional portion of a puzzle. The remaining panel portions 1004, 1006, 1008, 1010, and 1012 may then extend above the interlocking portion 1002 to join other three-dimensional tile pieces via tabs 1014 and form the three-dimensional puzzle portion.

Although embodiments disclosed herein disclose puzzles with a certain number and configuration of two- and three-dimensional puzzle portions, one of ordinary skill in the art would appreciate that any number and variety of configurations could be used. For example, one or multiple three-dimensional puzzle portions may be located around a single central two-dimensional puzzle portion. Therefore, notwithstanding the particular benefits associated with a three-dimensional puzzle portion that is located within a two-dimensional puzzle portion, the present invention should be considered broadly applicable to any arrangement of two- and three-dimensional puzzle portions forming an overall puzzle.

In other embodiments, a tool can be provided that assists in the placement and tensioning of the clips. The tools may apply the various connectors or fasteners. In some embodiments, folds can be used to achieve at least part of the three-dimensional structure. These folds can be preformed by compressing the paper, cardboard or plastic, or they can be preformed during plastic extrusion or as flexible living hinges. To assist in assembly, the lines to be folded can be designated to fold above the plane of the unfolded flattened tile or designated to fold below the plane of the unfolded flattened tile, such as valley or mountain folds. This designation can be made in any manner, including directions for assembly, by differing coloration of the fold lines, or by imprinting or compressing the stock.

In other embodiments, the two-dimensional puzzle portion may be omitted. The three-dimensional puzzle portion may be assembled and used for various purposes, such as a mask. For example, a Halloween mask may be assembled that include openings for eyes and a mouth, and the image may represent a particular character. Other uses may include models, buildings, decorations, lamp shades, window hangings where the materials are translucent or transparent, sculptures, posters, etc. For example, a poster may include a three-dimensional puzzle portion that is attachable to a poster base. Posters may be large, such as life-sized or larger, which may be too large to practically use a two-dimensional puzzle portion. A single-piece poster, however, may receive and combine with one or more three-dimensional puzzle portions as described above for two-dimensional puzzle portions. The poster may be made out of various materials including, but not limited to, vinyl, paper, cardboard, etc. The three-dimensional puzzle portions may be assembled and clipped or adhered to the poster base. For posters and other types of uses, the three-dimensional puzzle portion may be secured with clips, glue or other adhesive methods for a more permanent configuration.

FIGS. 11-17 illustrate various exemplary forms for U-shaped clips.

Figure 11A:
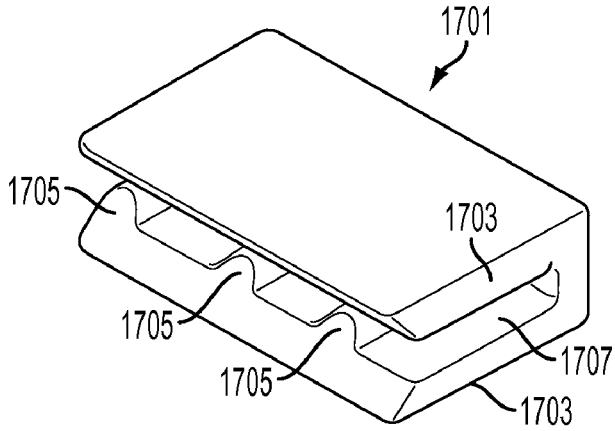
FIGS. 11A-11C are schematic diagrams of exemplary U-shaped clips for holding individual pieces of a three-dimensional section together.
Figure 11B:
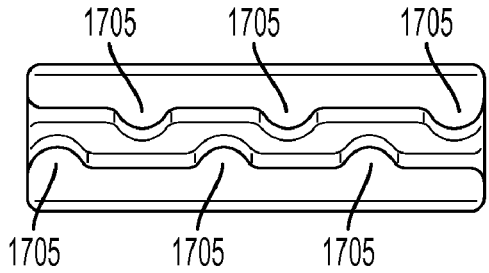
Figure 11C:
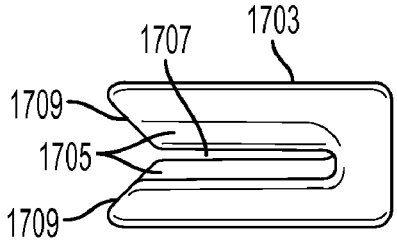

For example, FIGS. 11A-11C illustrate a large U-shaped clip 1701 with multiple protrusions 1705 on each arm 1703 of the U-shaped clip 1701. A recess 1707 may separate the arms 1703 and may receive tabs or other sections of puzzle pieces. In FIGS. 11A-11E, six protrusions 1705 are shown, but fewer or more protrusions 1705 may be used depending on particular uses. The protrusions 1705 are also shown staggered, but could be aligned. The height and width of the protrusions 1705 can be varied depending on the particular use, such as different materials of the puzzle pieces, different thicknesses of the puzzle pieces, etc. The U-shaped clips 1701 are preferably made of plastic or other similar materials, but could also be made from metal, rubber, natural materials, etc. One or more couplings may be used to secure each tab on a three-dimensional piece. Angled ends 1709 may assist in aligning the arms 1703, 1705 with puzzle pieces, and feeding the puzzle pieces into the recess 1707.

Figure 12A:
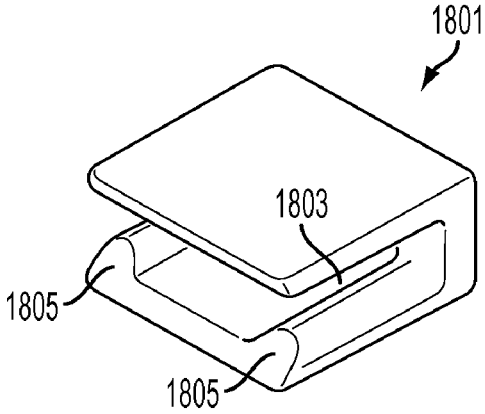
Figure 12B:
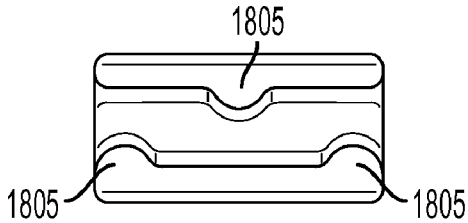
Figure 12C:
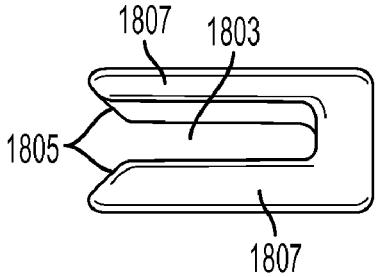

FIGS. 12A-12C show a smaller clip 1801 with a wide recess 1803. Three protrusions 1805 are shown on arms 1807, but other numbers may be used.

Figure 13A:
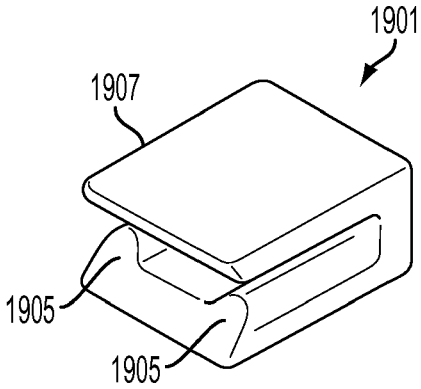
Figure 13B:
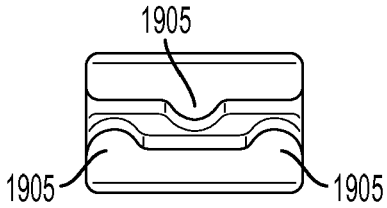
Figure 13C:
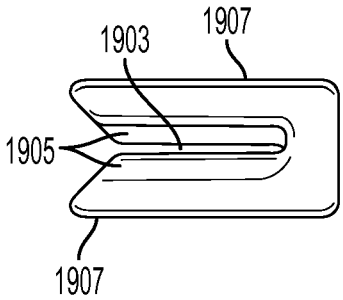
Figure 14A:
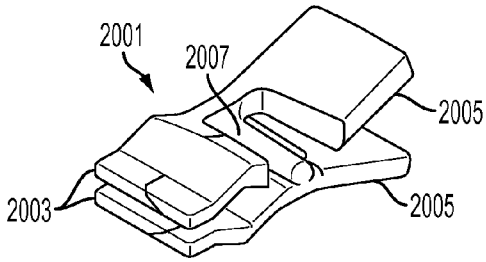
FIGS. 14A-14D are schematic diagrams of exemplary U-shaped clips for holding individual pieces of a three-dimensional section together.
Figure 14B:
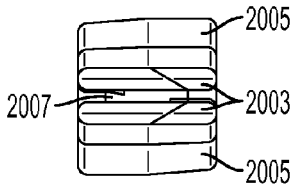
Figure 14C:
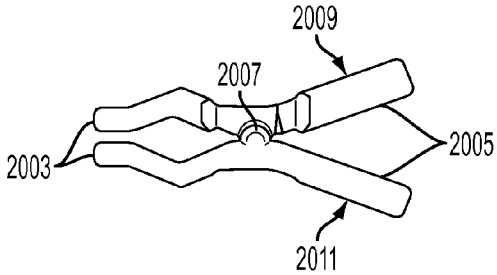
Figure 14D:
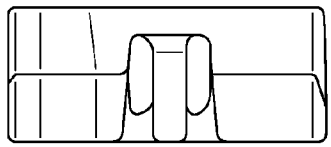

FIGS. 13A-13C show a smaller clip 1901 with a narrow recess 1903. Three protrusions 1905 are shown on arms 1907, but other numbers may be used.

FIGS. 14A-14D show a hinged U-shaped clip 2001. Compression arms 2003 and activation arms 2005 may pivot around a hinge 2007. The compression arms 2003 and activation arms 2005 may have various sizes and configurations depending on particular uses. A user may activate the clip 2001 by pressing the activation arms 2005 towards each other and inserting materials to be coupled between the compression arms 2003. The activation arms 2005 may then be released and the compression arms 2003 move toward one another and compress the material between the compression arms 2003. The clip 2001 may include two or more sections 2009, 2011, where the sections are joined by mating sections of the hinge 2007.

Figure 15A:
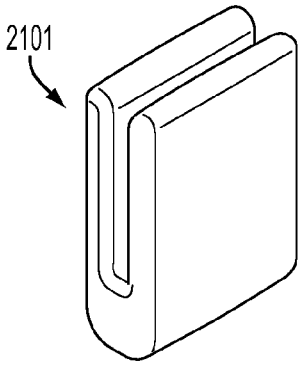
FIGS. 15A-15C are schematic diagrams of exemplary U-shaped clips for holding individual pieces of a three-dimensional section together.
Figure 15B:
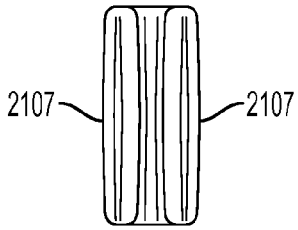
Figure 15C:
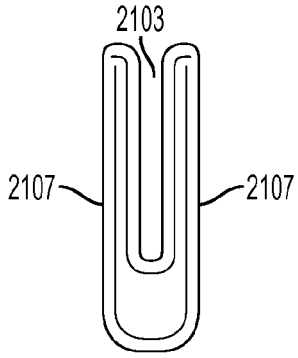

FIGS. 15A-15C show a U-shaped clip 2101 with a recess 2103, but no protrusions 2105. The puzzle pieces are held by compression forces from arms 2107.

Figure 16A:
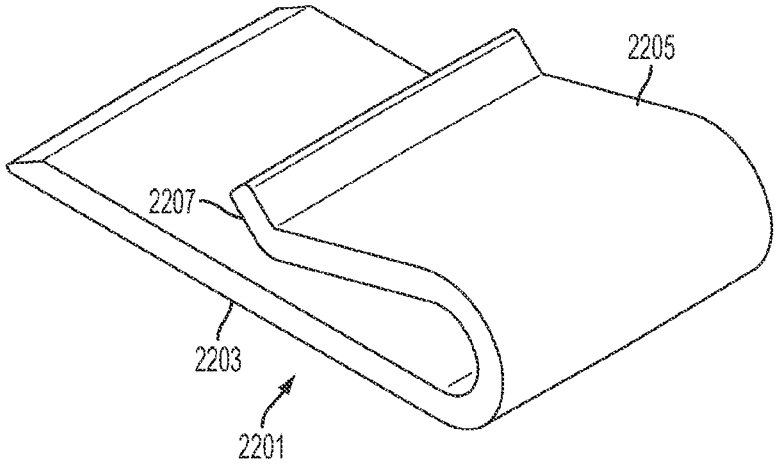
FIGS. 16A-16C are schematic diagrams of exemplary U-shaped clips for holding individual pieces of a three-dimensional section together.
Figure 16B:
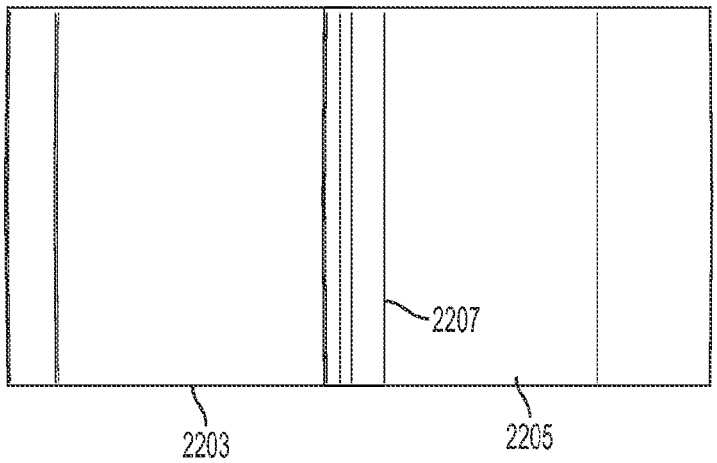
Figure 16C:
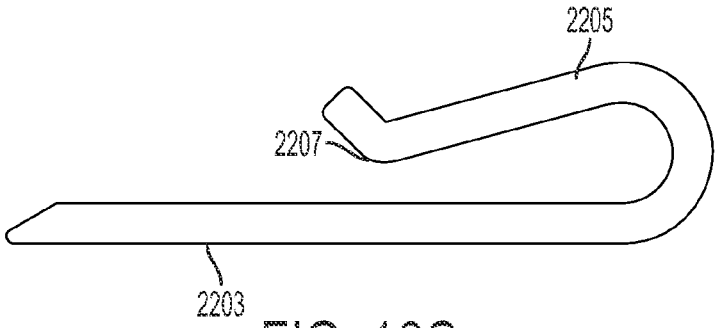

FIGS. 16A-16C show a non-symmetrical U-shaped clip 2201 with a first arm 2203 longer than a second arm 2205. The arms 2203, 2205 may be variously configured, but a first arm 2203 may be relatively planar, while the second arm 2205 includes a turn. An apex 2207 of the turn may provide force to hold materials in the U-shaped clip 2201. The size and configuration of the clip 2201 may vary depending on the user.

Figure 17A:
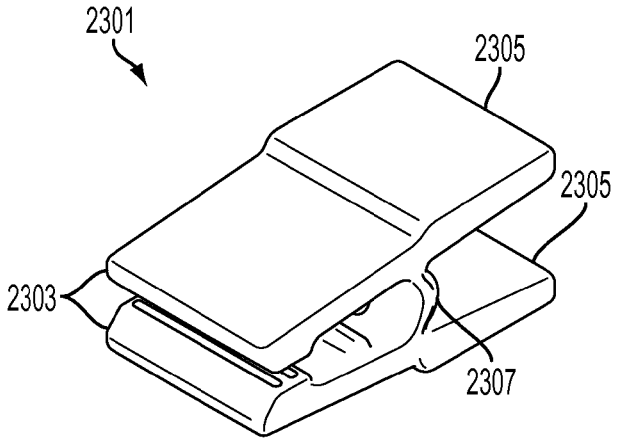
FIGS. 17A-17C are schematic diagrams of exemplary U-shaped clips for holding individual pieces of a three-dimensional section together.
Figure 17B:
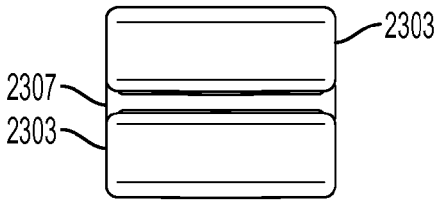
Figure 17C:
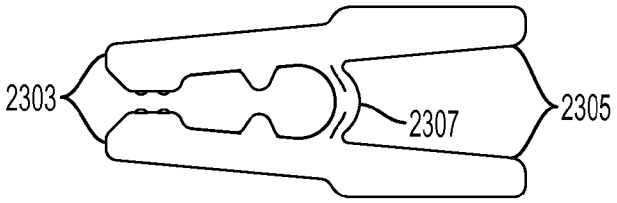

FIGS. 17A-17C show a single piece hinged U-shaped clip 2301. Compression arms 2303 and activation arms 2305 may pivot around a hinge 2307. The compression arms 2303 and activation arms 2205 may have various sizes and configurations depending on particular uses. A user may activate the clip 2301 by pressing the activation arms 2305 towards each other and inserting materials to be coupled between the compression arms 2303. The activation arms 2305 may then be released and the compression arms 2303 move toward one another and compress the material between the compression arms 2303. The clip 2301, including the hinge 2307, may be molded as a single piece or may be more than one piece. One or more protrusions 2309 may extend from inner surfaces of the compression arms 2303. The one or more protrusions 2309 may align with one or more protrusions on the opposite compression arm 2303, or they may be staggered.

While this invention is satisfied by embodiments in many different forms, as described in detail in connection with preferred embodiments of the invention, it is understood that the present disclosure is to be considered as exemplary of the principles of the invention and is not intended to limit the invention to the specific embodiments illustrated and described herein. Numerous variations may be made by persons skilled in the art without departure from the spirit of the invention. The scope of the invention will be measured by the appended claims and their equivalents.

The invention claimed is:

1. A puzzle apparatus comprising:

a two-dimensional planar section comprising a plurality of planar pieces;

a three-dimensional section comprising a plurality of three-dimensional pieces, wherein each of the plurality of three-dimensional pieces comprises one or more tabs, wherein the one or more tabs are folded into engagement with one or more tabs on one or more adjacent three-dimensional pieces and secured to the one or more tabs on the one or more adjacent three-dimensional pieces with one or more couplings; and one or more fasteners for coupling the two-dimensional planar section to the three-dimensional section.

2. The apparatus of claim 1, wherein the individual three-dimensional pieces are initially planar.

3. The apparatus of claim 2, wherein the individual three-dimensional pieces are foldable.

4. The apparatus of claim 3, wherein folds of the individual three-dimensional pieces are designated to fold below a horizontal plane of the unfolded individual three-dimensional pieces.

5. The apparatus of claim 3, wherein folds of the individual three-dimensional pieces are designated to fold above a horizontal plane of the unfolded individual three-dimensional pieces.

6. The apparatus of claim 1, wherein the two-dimensional planar section comprises an opening to accommodate the three-dimensional section.

7. The apparatus of claim 1, wherein the three-dimensional section extends away from the plane of the two-dimensional planar section.

8. The apparatus of claim 1, wherein the plurality of planar pieces comprise flat irregularly shaped interlocking puzzle pieces.

9. The apparatus of claim 1, wherein the couplings are U-shaped clips.

10. The apparatus of claim 1, wherein the couplings are selected from the group consisting of: staples, glue, tape, and combinations thereof.

11. The apparatus of claim 1, wherein the two-dimensional planar section defines an opening, and wherein the three-dimensional section is disposed within the opening.

12. The apparatus of claim 11, wherein the three-dimensional section defines a base perimeter, and wherein the opening matches the base perimeter to provide an interference fit between the two-dimensional planar section and three-dimensional section.

13. The apparatus of claim 1, wherein the plurality of planar pieces comprise flat irregularly shaped interlocking puzzle pieces, and wherein at least one of the plurality of three-dimensional pieces comprises a base panel portion and an interlocking panel portion, wherein the at least one of the plurality of three-dimensional pieces is foldable between the base panel portion and the interlocking panel portion such that the interlocking panel portion occupies the plane of the two-dimensional planar section and interlocks with a planar piece, and the base panel portion extends away from the plane of the two-dimensional planar section.

14. The apparatus of claim 1, further comprising an L-shaped connector that connects the two-dimensional planar section to the three-dimensional section.

15. The apparatus of claim 1, wherein at least one of the plurality of three-dimensional pieces comprises portions that interlock with at least one of the plurality of planar pieces.

16. The apparatus of claim 1, wherein the couplings are applied with a tool.

17. A method of assembling a puzzle, the method comprising:

providing a puzzle, wherein the puzzle comprises:

a two-dimensional planar section comprising a plurality of planar pieces;

a three-dimensional section comprising a plurality of three-dimensional pieces, wherein each of the plurality of three-dimensional pieces comprises one or more tabs;

one or more couplings; and one or more connectors;

assembling the plurality of planar pieces;

folding the one or more tabs into engagement with one or more tabs on one or more adjacent three-dimensional pieces;

coupling the one or more tabs together with the one or more tabs on one or more adjacent three-dimensional pieces with the one or more couplings; and coupling the two-dimensional planar section to the three-dimensional section with the one or more connectors.

18. The method of claim 17, further comprising gluing the two-dimensional planar section prior to coupling the two-dimensional planar section to the three-dimensional section.

19. The method of claim 17, wherein the one or more couplings are one or more U-shaped coupling.

20. The method of claim 17, wherein the one or more couplings are selected from the group consisting of: staples, glue, tape, and combinations thereof.

21. The method of claim 17, wherein the individual three-dimensional pieces are initially two-dimensional and are foldable.

* * * * *